US007252021B1

(12) United States Patent
Linscott

(10) Patent No.: US 7,252,021 B1
(45) Date of Patent: Aug. 7, 2007

(54) ROOF SHINGLE AND NAIL REMOVER

(76) Inventor: Herbert Garfield Linscott, 71 Nokomis Rd., Hingham, MA (US) 02043

( * ) Notice: Subject to any disclaimer, the term of this patent is extended or adjusted under 35 U.S.C. 154(b) by 0 days.

(21) Appl. No.: 10/859,711

(22) Filed: Jun. 3, 2004

(51) Int. Cl.
*E04D 15/00* (2006.01)

(52) U.S. Cl. ..... 81/45; 299/36.1

(58) Field of Classification Search ..... 81/45, 81/46; 299/36.1; 254/18, 21, 131.5; 30/171, 30/172
See application file for complete search history.

(56) References Cited

U.S. PATENT DOCUMENTS

| | | | | |
|---|---|---|---|---|
| 1,211,655 | A | 1/1917 | Carrick | |
| 2,594,598 | A | 4/1952 | Timmins | |
| 3,074,694 | A * | 1/1963 | Erickson, Jr. | 30/172 |
| 3,251,629 | A | 5/1966 | Cawley | |
| 3,542,433 | A | 11/1970 | Probst | |
| 3,563,608 | A | 2/1971 | Crispino | |
| 3,779,605 | A | 12/1973 | Nieman | |
| 4,086,699 | A | 5/1978 | Olkkola | |
| 4,203,210 | A | 5/1980 | Hadlick, Jr. | |
| 4,466,188 | A | 8/1984 | Svendsgaard | |
| 4,699,430 | A | 10/1987 | Nichols | |
| 4,709,479 | A | 12/1987 | Lavelette | |
| 4,763,547 | A | 8/1988 | Dike, Jr. | |
| 4,858,503 | A | 8/1989 | Dike, Jr. | |
| 4,865,372 | A | 9/1989 | Gabriel | |
| 5,001,946 | A | 3/1991 | Shirlin et al. | |
| 5,010,791 | A | 4/1991 | Williams | |
| 5,098,165 | A | 3/1992 | Jacobs et al. | |
| 5,280,676 | A | 1/1994 | Fieni | |
| 5,800,021 | A | 9/1998 | Derr | |
| 5,813,295 | A | 9/1998 | Jensen, Jr. | |
| 5,836,222 | A | 11/1998 | Harpell | |
| 5,863,100 | A | 1/1999 | Martin | |
| 5,893,304 | A | 4/1999 | Carroll | |
| 5,906,145 | A | 5/1999 | Shepherd | |
| 5,921,155 | A | 7/1999 | Faller et al. | |
| 6,095,015 | A | 8/2000 | Phelan | |
| 6,105,469 | A | 8/2000 | Gracy | |
| 6,105,470 | A | 8/2000 | Hutchins | |
| 6,128,979 | A | 10/2000 | Shepherd | |
| 6,257,094 | B1 | 7/2001 | Babich | |
| 6,339,975 | B1 | 1/2002 | Harpell | |

* cited by examiner

*Primary Examiner*—D. S. Meislin
(74) *Attorney, Agent, or Firm*—Law Offices of Michael Leccese, P.C.

(57) ABSTRACT

A hand tool for removing roofing shingles and nails. The toll has a head attached to an elongated handle. The head has a wedge-shaped cross profile. The head is comprised of a plurality of identical, parallel blades, having a relatively flat, pointed leading edge adapted to being inserted underneath the exposed edge of a shingle to be removed. The blade leading edge rises in vertical height to a trailing edge. The trailing edge is connected to a handle. Spacers are attached between the blades to form spacing between blades sufficient to trap any roofing nails holding a shingle to an underlying roof sheath.

10 Claims, 6 Drawing Sheets

ROOF SHINGLE AND NAIL REMOVER

BACKGROUND OF THE INVENTION

This invention relates to hand tools, and in particular, to a hand tool for simultaneously removing shingles and nails from a roof.

Roofs for many contemporary single family and multiple family dwelling structures utilize an outer roof covering consisting of fibrous shingles nailed to a plywood sheathing roof construction. The roofs are covered with a plurality of overlapping, horizontally aligned rows of shingles. The shingles may be made of asphalt or wood and are nailed or stapled to the underlying plywood sheathing. Generally, beginning with the bottom or lower-most edge of the roof, the shingles are nailed in place with successive layers or rows overlapping the top of the preceding below-mounted row. The shingles are generally attached to the roof sheathing by nails or staples.

Due to the inherent exposure to the elements, roofing materials have a limited effective life. This means that roofing materials must be replaced periodically during the useful life of the dwelling structure to ensure continued protection from weather. Replacement usually requires that all of the roofing materials be removed and replaced with new roofing materials. Since roofing materials are generally attached to a structure by fastening elements such as nails or staples, removal is difficult, tedious, and dangerous.

Various tools have heretofore been provided for removing old shingles preparatory to the installation of new roofing material. Designs heretofore provided either do not provide sufficient mechanical advantage for ease in removal of roofing nails or are not efficient for rapid removal. Nearly all prior art tools require a physical prying motion by the tool user. Typically, shingles are removed from a roof structure by using a chisel or pry bar type tool or spade fork leaving nails behind for a second operation with a claw hammer. The process involves inserting the chisel or pry bar underneath the uppermost shingle and then lifting the exposed end of the chisel or pry bar to push the uppermost shingle away from the underlying shingles. The process is time-consuming and relatively inefficient. Usually several back and forth motions of the chisel or pry bar are required to remove a given shingle from the roof surface.

SUMMARY OF THE INVENTION

This invention, although useful for all types of roofing removal, is especially useful for removing single layer shingles attached to plywood sheathing with nails or staples. The present invention provides a hand tool for removing shingles and roof nails from a roof quickly and with less effort on the part of the user. In a preferred embodiment of the invention, the tool has a head attached to an elongated handle. The head has a wedge-shaped cross profile, said head being comprised of a plurality of identical, parallel blades, having a relatively flat, pointed leading edge adapted to being inserted underneath the exposed edge of a shingle to be removed, said leading edge rising in height to a trailing edge, said trailing edge being connected to a handle. The spacing between blades is sufficient to trap any roofing nails holding the shingle to the underlying roof sheath. As the tool is pushed forward, the rising height of the head pushes up the shingle and extracts the captured nails. No prying motion by the user is required.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
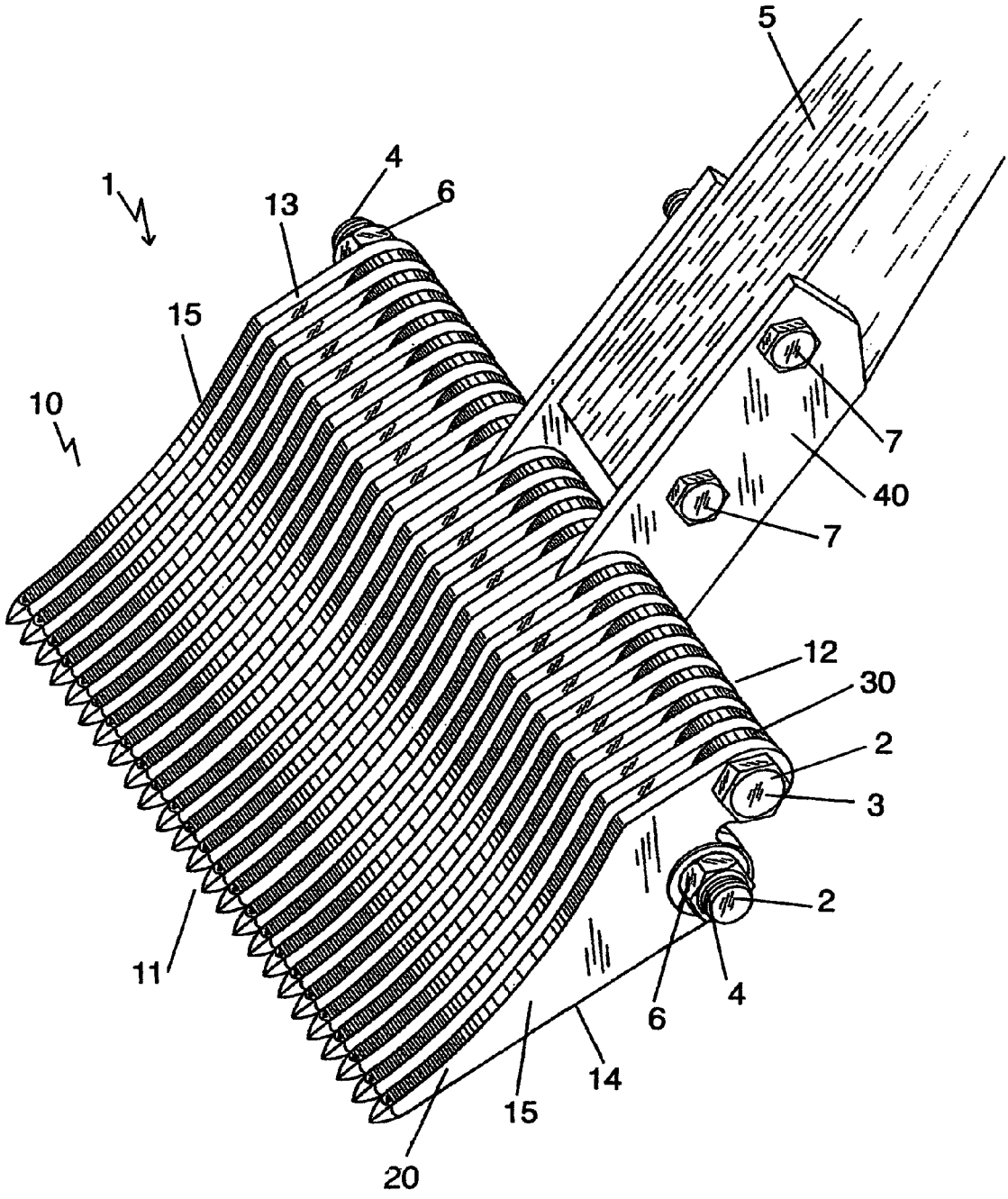
FIG. 1 is a top-front perspective view of the invention.
Figure 2:
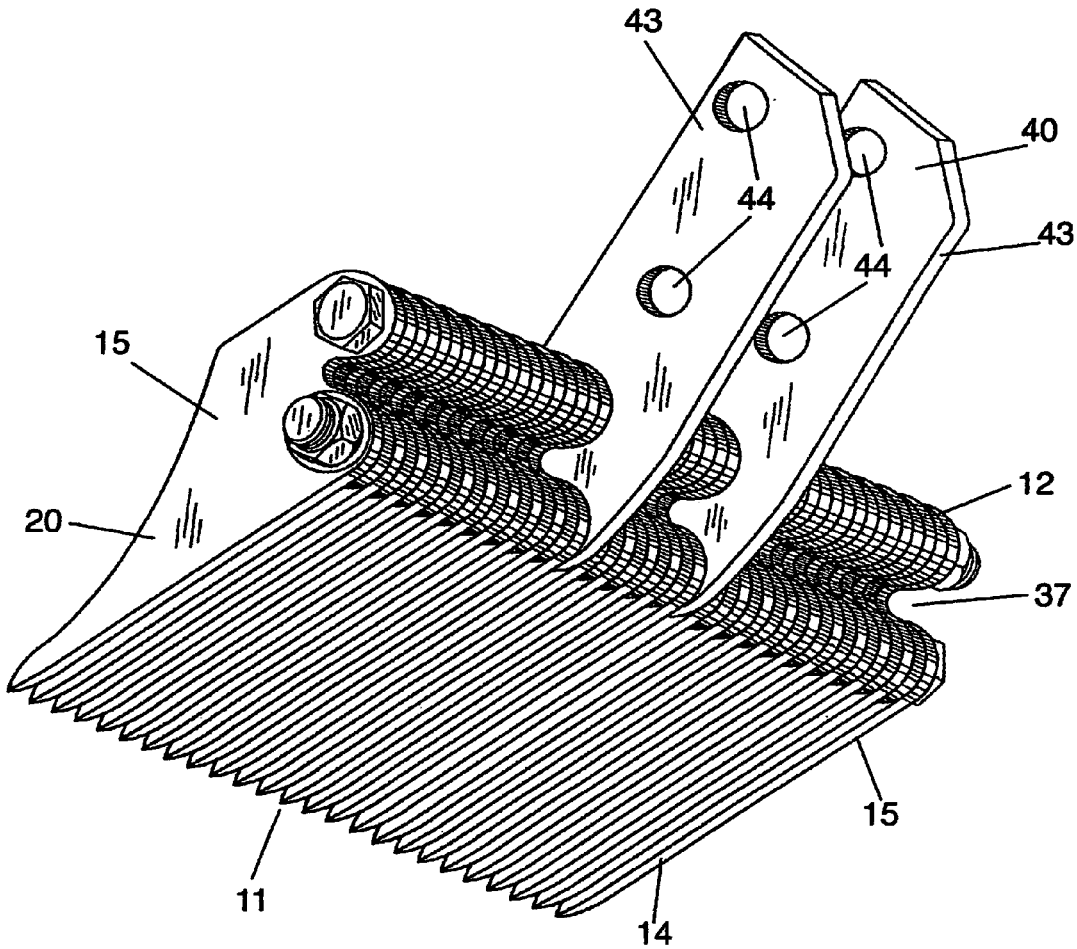
FIG. 2 is a bottom-rear perspective thereof without a handle.
Figure 3:
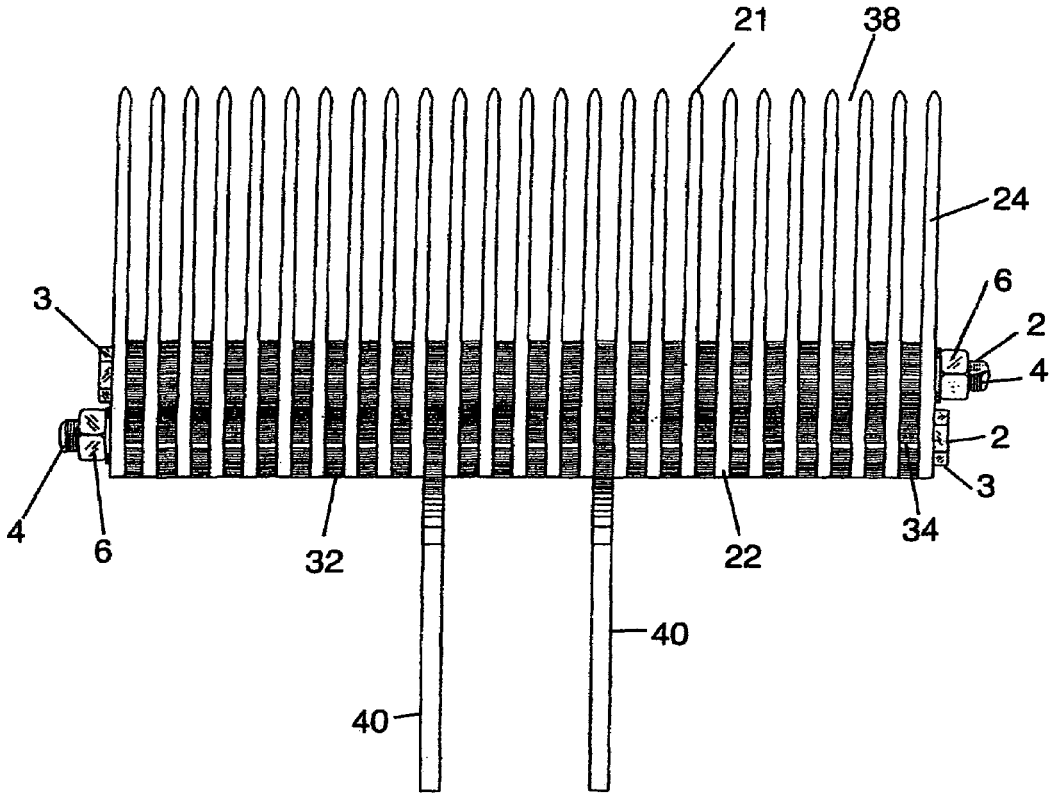
FIG. 3 is a bottom view thereof.
Figure 4:
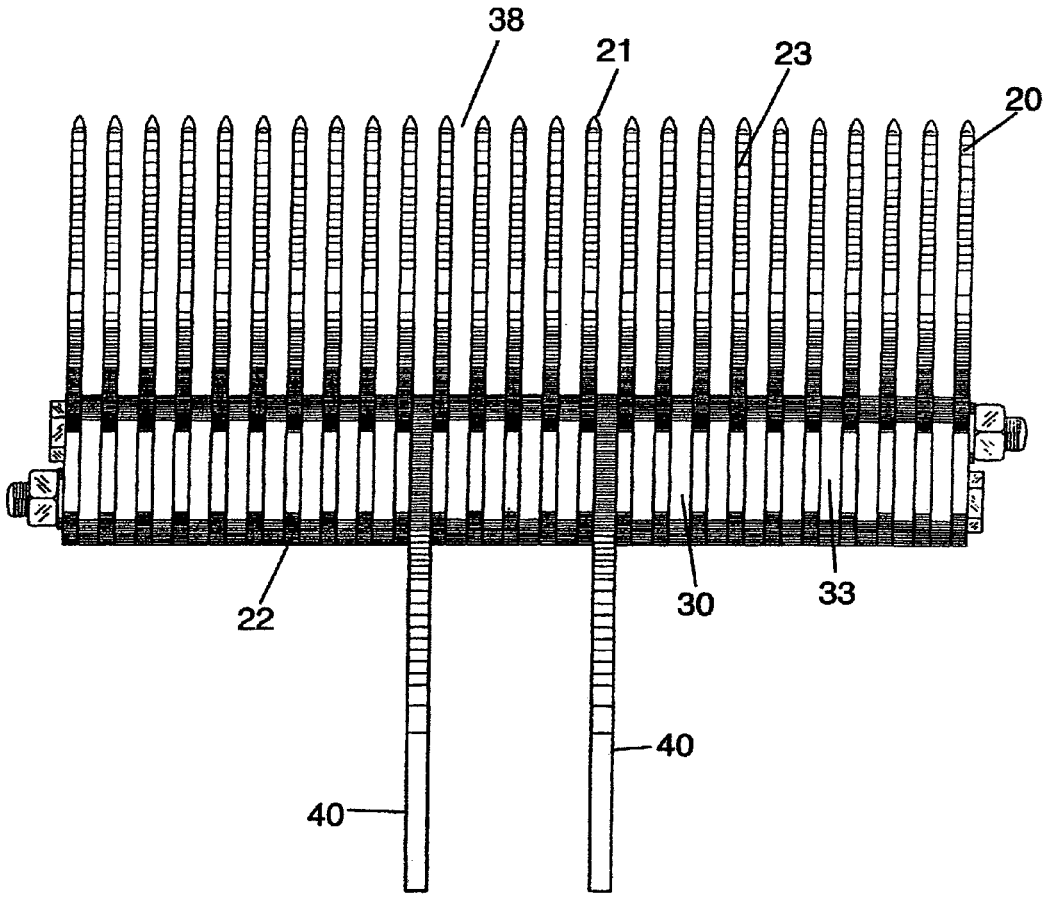
FIG. 4 is a top view thereof.
Figure 5:
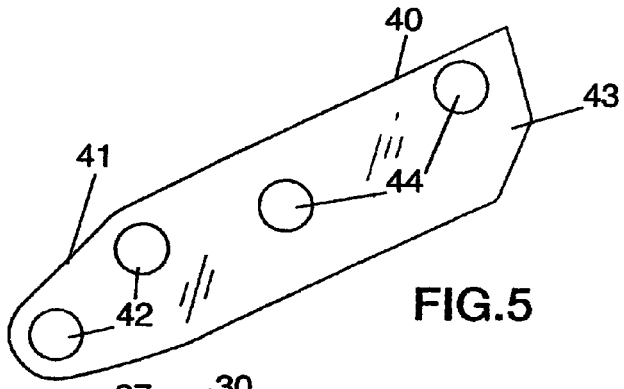
FIG. 5 is a side elevational view of a handle attachment piece.
Figure 6:
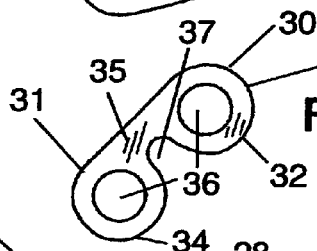
FIG. 6 is a side elevational view of a spacer piece.

Referring to the drawings in detail wherein like elements are indicated by like numerals, there is shown a roof shingle and nail remover hand tool 1 constructed according to the principles of the present invention. The tool 1 is comprised generally of a head assembly 10 attached to an elongated handle 5, said head assembly 10 having a wedge-shaped cross-sectional profile. The head 10 has a front, leading edge 11, a rear, trailing edge 12, a top 13, a flat bottom 14, and two opposite, parallel sides 15, said front 11 and rear 12 defining a head assembly longitudinal axis. The head assembly 10 is comprised of a number of identical, parallel blades 20 with spacers 30 there between. Two handle attachment pieces 40 replace two of the spacers 30 and are adapted to provide attachment means for the handle 5. The handle 5 is attached to the head assembly rear 12.

Each blade 20 has a front leading edge 21, rear trailing edge 22, top 23, bottom 24, and two opposing, parallel sides 25. The front leading edge 21 and rear trailing edge 22 define a blade longitudinal axis. The blade 20 has a narrow side-to-side width in relation to its front-to-rear length. The blade front leading edge 21 is relatively flat and pointed. The side profile of the blade bottom 24 is flat. The side profile of the blade top 23 has a forward section 27 and a rearward section 28, said forward section 27 being defined as a section from the blade leading edge 21 to a designated point 26, said rearward section 28 being defined as a section from the designated point 26 to the blade rear trailing edge 22. The forward section 27 has a curvilinear rising profile from the flat, pointed leading edge 21 to the designated longitudinal point 26. The rearward section 28 from the designated point 26 to the rear trailing edge is flat, parallel to the blade bottom 24. The blade 20 has two round side-to-side holes 29 formed therein near to the blade rear 22, said holes 29 are preferably positioned one over another and at a vertical angle to each other.

Figure 7:
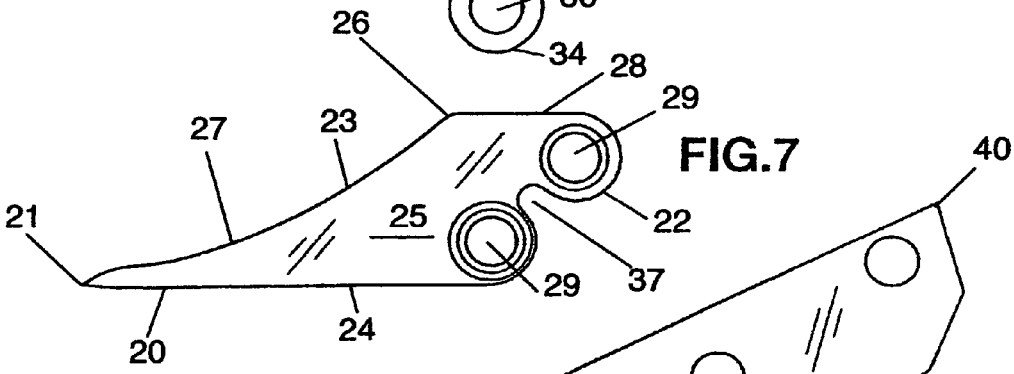
FIG. 7 is a side elevational view of a blade.
Figure 8:
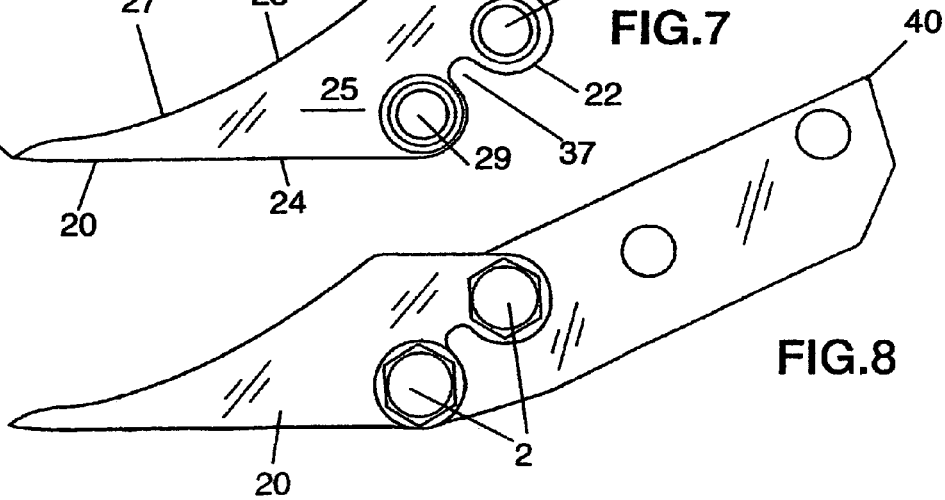
FIG. 8 is a side elevational view of the head.
Figure 9:
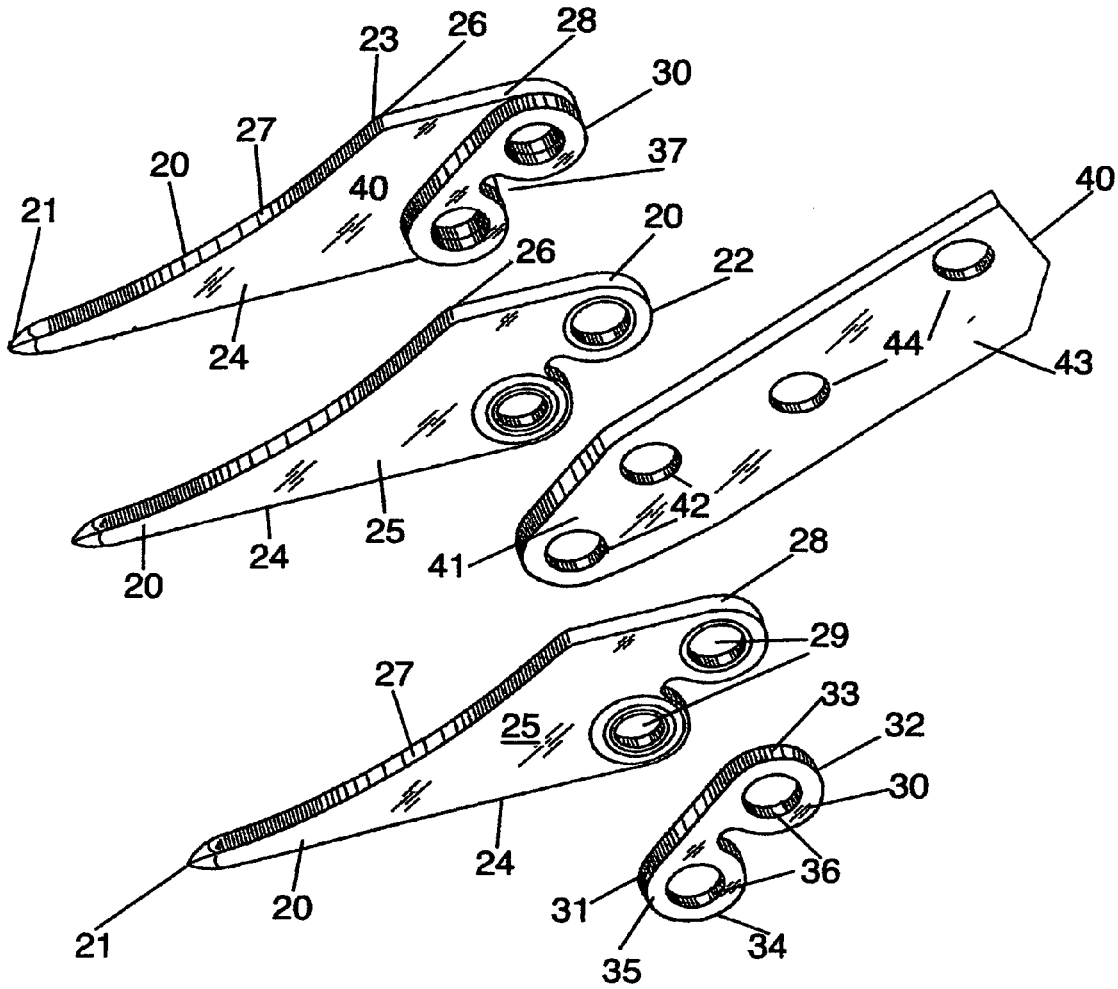
FIG. 9 is a partial exploded view of the head.

As may be most clearly seen in FIGS. 7 and 8, the blade front leading edge 11 is flat and just thinner than the nail head protrusion in order to engage and seat the nail head on the blade top 23. This prevents sudden shearing or tipping of the nail head. The blade leading edge 11 also is slightly rounded in all directions to prevent the blade leading edge 11 from digging into the underlying plywood sheathing and to deflect debris away from the gullets formed between blades by the spacers. The shape of the incline of the top 23 of the blade forward section 27 is an arc which allows for a low angle efficient wedge when the nail is at its tightest, but rises rapidly as the nail loosens. Total rise is determined by nail length and is no higher than the nail length to maximize the cleaning action of the shank. The nail is typically fully disengaged from the plywood sheathing at the blade top designated point 26 and is carried away by an attached shingle. As the head assembly 10 continues to move forward, the shape of the forward portion of the spacer 30 combined with the force of the next nail coming through causes any debris or loose nails to be expelled from the head assembly 10. The blade rear 22 and spacer rear 32 may have channels 37 formed therein to remove weight from the head assembly 10 without sacrificing strength.

Each spacer 30 has a front 31, rear 32, top 33, bottom 34, and two opposing, parallel sides 35. The spacer 30 has a narrow side-to-side width. Each spacer 30 has two round side-to-side holes 36 formed therein, preferably positioned one over another and at a vertical angle to each other.

The head assembly 10 is comprised of a number of aligned blades 20 with spacers 30 in between, so that the blade holes 29 and spacer holes 36 are aligned. The alternate spacer 30, blade 20 arrangement form open gullets 38 between the blades 20. Two of the spacers 30 are replaced with handle attachment pieces 40. Each handle attachment piece 40 has a front section 41 having a profile and thickness identical to that of a spacer 30, including two vertically angled, side-to-side holes 42. Each attachment piece 40 has an elongated rear section 43 with two side-to-side holes 44 formed therein along the rear section length.

Two bolts 2, each bolt having a head 3 and an opposite threaded end 4, are inserted through the holes 29, 36, and 42. The bolt heads 3 each have a diameter greater than the diameters of the blade holes 29, spacer holes 36, and attachment piece holes 42. A fastener 6 is then threadingly attached to said bolt threaded ends 4 thereby holding the blade and spacer head assembly 10 in place. The bolts 2 with engaged fasteners 6 compress the blades 20 and spacers 30 together providing substantial strength to the head assembly 10.

The head assembly 10 is attached to a handle 5. The handle 5 is adapted to fit between the attachment piece rear sections 43. Handle bolts 7 are inserting through the attachment piece rear section holes 44 and through corresponding holes (not shown) formed in the handle 5. Fasteners (not shown) are attached to the handle bolts 7 thereby securing the handle 5 to the attachment pieces 40.

The object of the invention tool 1 to separate shingles and nails from a roof surface in one continuous forward movement without a second prying motion. The blade 20 size and shape and spacing between blades, permits the head assembly leading edge 11 to by-pass by nail shanks and engage nail heads vertically on the blade tops 23. The forward motion of the head assembly 10 and the rise of the blade tops 23 forces nails upward and out of the underlying plywood sheathing. The flatness of the head assembly bottom 14 keeps the tool head 10 properly aligned against the underlying plywood sheathing. Combined with the force of incoming nails, the slanted position of the forward portions of the spacers 30 allows the nails and debris to pass out of the head assembly 10 unhindered. The head assembly 10 is therefore self-cleaning.

The width of the spacers 30 are a function of the nail sizes to be removed from the roof. The blade fronts 21 are pointed creating funnels which most often allows the gullets 38 to engage nail shanks. Furthermore, the blades 20 are fastened to the head assembly 10 at the blade rears 22 providing less rigidity and some flexibility in the blade leading edges 21. This further enhances the ability of the head assembly leading edge 11 to engage nail shanks.

It is understood that the above-described embodiment is merely illustrative of the application. Other embodiments may be readily devised by those skilled in the art which will embody the principles of the invention and fall within the spirit and scope thereof. In an alternative embodiment, the head assembly 10 could be made or formed from one piece. However, applicant believes the preferred embodiment is the laminated version described above. Spacers and/or blades of different thicknesses may be assembled to accommodate different roofing structures.

I claim:

1. A hand tool adapted for separating roofing shingles and nails from a roof surface in one continuous forward motion without a second prying motion, comprising:

an elongated handle;

a head assembly having a wedge-shaped cross profile, and having a front, leading edge, a rear, trailing edge, a top, a flat bottom, and two opposite, parallel sides, said front and rear defining a head assembly longitudinal axis, said head assembly trailing edge being attached to said elongated handle, said head assembly being comprised of, a plurality of identical, parallel blades, having a pointed leading edge adapted to being inserted underneath an exposed edge of a roofing shingle to be removed, each said blade having a front leading edge rising in vertical height to a rear trailing edge, each said blade has said front leading edge, said rear trailing edge, a top, a bottom, and two opposing, flat, parallel sides, said front leading edge and rear trailing edge defining a blade longitudinal axis, each said blade having a narrow side-to-side width in relation to a front-to-rear length, each said blade having a flat bottom side profile;

a plurality of spacers interspersed between said blades; wherein open, elongated gullets are formed between each blade, and;

a two handle attachment pieces replacing two of the spacers, said attachment pieces adapted to provide attachment means for the handle, the side profile of the blade top has a forward section from the blade leading edge to a longitudinal designated point and a rearward section from the designated point to the blade rear trailing edge, said forward section having a curvilinear rising side profile from the flat, pointed leading edge to the longitudinal designated point, said rearward section from the designated point to the rear trailing edge being flat and parallel to the blade bottom.

2. A hand tool as recited in claim 1, wherein:

each said blade has two round side-to-side holes formed therein near to the blade rear, said holes being positioned one over another and at a vertical angle to each other.

3. A hand tool as recited in claim 2, wherein:

each spacer has a front, rear, top, bottom, and two opposing, parallel sides, each said spacer having a narrow side-to-side width, each said spacer having two round side-to-side holes formed therein, said holes being positioned one over another and at a vertical angle to each other, each spacer front and top forming a rearwardly and upwardly slanting surface.

4. A hand tool as recited in claim 3, wherein:

each handle attachment piece has a front section having a profile and thickness identical to that of a spacer, including two vertically angled, side-to-side holes, and an elongated rear section with two side-to-side holes formed therein along the rear section length.

5. A hand tool as recited in claim 4, wherein:

the head assembly blades, spacers and attachment pieces are aligned so that their holes are coincident.

6. A hand tool as recited in claim 5, further comprising:

two elongated bolts, each bolt having a head and an opposite threaded end, said bolts adapted to be inserted through the blade, spacer and attachment piece holes, said bolt heads each having a diameter greater than diameters of the blade holes, spacer holes, and attachment piece holes; a plurality of fasteners, each said fastener being threadingly attached to said bolt threaded ends, said bolts with engaged fasteners compressing the blades, spacers and attachment pieces together.

7. A hand tool as recited in claim 6, wherein:

said elongated handle is adapted to fit between the attachment piece rear sections and attached to said attachment piece rear sections by handle bolts inserted through the attachment piece rear section holes and through corresponding holes formed in the handle.

8. A hand tool as recited in claim 7, wherein:

the spacers between blades permits the head assembly leading edge to by-pass a nail shank and engage a nail head vertically on the blade tops.

9. A hand tool as recited in claim 8, wherein:

the forward motion of the head assembly and the rise of the blade tops are adapted to force nails upward and out of the underlying roof surface, wherein the flatness of the head assembly bottom is adapted to keeping the head assembly aligned against the underlying roof surface, wherein each spacer front and top slanting surface allows nails to pass out of the head assembly unhindered.

10. A hand tool as recited in claim 9, further comprising:

a channel in each blade rear trailing edge, spacer rear and handle attachment piece.

* * * * *